US009738491B2

(12) United States Patent
Dudde et al.

(10) Patent No.: US 9,738,491 B2
(45) Date of Patent: Aug. 22, 2017

(54) HYDRAULIC-BOOSTED RAIL BRAKE

(71) Applicant: ThyssenKrupp Elevator AG, Essen (DE)

(72) Inventors: Frank P. Dudde, Collierville, TN (US); Peter F. Feldhusen, Collierville, TN (US); William K. Delk, Olive Branch, MS (US); Mike Palazzola, Horn Lake, MS (US); Jie Xu, Cordova, TN (US); Alan M. Parker, Byhalia, MS (US); John Keith Anderson, Jackson, TN (US); Olivia Stone, Memphis, TN (US)

(73) Assignee: THYSSENKRUPP ELEVATOR AG, Essen (DE)

( * ) Notice: Subject to any disclaimer, the term of this patent is extended or adjusted under 35 U.S.C. 154(b) by 58 days.

(21) Appl. No.: 14/609,729

(22) Filed: Jan. 30, 2015

(65) Prior Publication Data

US 2016/0221795 A1 Aug. 4, 2016

(51) Int. Cl.
*B66B 5/18* (2006.01)

(52) U.S. Cl.
CPC ..... *B66B 5/18* (2013.01)

(58) Field of Classification Search
CPC ..... F16D 59/02; B66B 5/18
USPC ..... 187/359
See application file for complete search history.

(56) References Cited

U.S. PATENT DOCUMENTS 4,033,434 A * 7/1977 Henrich ..... F16D 49/16 188/171
5,014,828 A * 5/1991 Baldassarre ..... B66B 5/18 187/288
5,244,060 A * 9/1993 Tanaka ..... B66B 1/32 187/261
5,265,701 A * 11/1993 Ogasawara ..... B66B 5/18 187/254
5,323,878 A * 6/1994 Nakamura ..... B66B 1/32 187/264

(Continued)

FOREIGN PATENT DOCUMENTS

EP 1657203 5/2006

OTHER PUBLICATIONS

Trinkel, Bud "Hydraulics & Pneumatics," Book 2, Chapter 8: Directional Control Valves (2008), available at http://hydraulicspneumatics.com/other-technologies/book-2-chapter-8-directional-control-valves.

(Continued)

*Primary Examiner* — Michael Riegelman
(74) *Attorney, Agent, or Firm* — Lathrop & Gage L.L.P.

(57) ABSTRACT

A hydraulic-boosted rail brake is provided for use with an elevator having a guide rail. The rail brake includes a braking plate having friction material, a spring package in communication with the braking plate, a hydraulic cylinder, a piston housed at least partially inside the hydraulic cylinder, and a brake controller. The braking plate is selectively movable relative to the guide rail, and the spring package biases the friction material to interact with the guide rail to cause braking. The piston is in communication with the braking plate and is selectively: (a) movable in a release direction to diminish or overcome force from the spring package; and (b) movable in an engage direction to supplement the force from the spring package. The brake controller selectively causes the piston to move in the release direction and in the engage direction.

10 Claims, 6 Drawing Sheets

(56) References Cited

U.S. PATENT DOCUMENTS

| | | | | |
|---|---|---|---|---|
| 5,648,644 | A * | 7/1997 | Nagel | B66B 5/18 187/288 |
| 6,142,266 | A * | 11/2000 | Appeldorn | B60T 13/743 188/171 |
| 6,193,026 | B1 * | 2/2001 | Sevilleja | B60T 13/22 187/288 |
| 7,360,630 | B2 | 4/2008 | Brant | |
| 2011/0100761 | A1 | 5/2011 | Dudde et al. | |
| 2016/0152441 | A1 * | 6/2016 | Tschuppert | B66B 5/18 303/10 |

OTHER PUBLICATIONS

PCT Application No. PCT/EP2016/051492, International Search Report and Written Opinion, dated Aug. 3, 2016, 14 pages.

* cited by examiner

HYDRAULIC-BOOSTED RAIL BRAKE

BACKGROUND

Elevators typically include three separate braking systems: one for operational braking to hold an elevator car at respective landings, one for emergency braking for slowing the car if upward or downward speed of the car is too great, and one for safety braking to stop the car if a free-fall would otherwise occur. While some prior art systems combine two or more of these braking systems together into a single brake, such brakes have failed to correctly apply braking forces for each task. So, for example, a brake may provide both operational braking and emergency braking, but that brake may not be able to consistently apply correct braking forces and also consistently apply correct emergency braking forces.

The present disclosure relates generally to elevator braking systems using hydraulic pressure and spring forces to accomplish at least two of: (a) operational braking; (b) emergency braking; and (c) safety braking.

SUMMARY

The following presents a simplified summary in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In one embodiment, a hydraulic-boosted rail brake for use with an elevator having a guide rail includes a braking plate, a spring package, a hydraulic cylinder, a piston, and a brake controller. The braking plate has friction material and is selectively movable relative to the guide rail. The spring package is in communication with the braking plate and biases the friction material to interact with the guide rail, thereby causing braking. The piston is housed at least partially inside the hydraulic cylinder, is in communication with the braking plate, and is selectively: (a) movable in a release direction to weaken or overcome force from the spring package, and (b) movable in an engage direction to supplement the force from the spring package. The brake controller selectively causes the piston to move in the release direction and in the engage direction.

In another embodiment, a hydraulic-boosted rail brake for use with an elevator having a guide rail includes a braking plate, a spring package, a first hydraulic cylinder, a first piston, a second hydraulic cylinder, a second piston, and a brake controller. The braking plate has friction material and is selectively movable relative to the guide rail. The spring package is in communication with the braking plate and biases the friction material to interact with the guide rail, whereby causing braking. The first piston is housed at least partially inside the first hydraulic cylinder, is in communication with the braking plate, and is selectively movable in a release direction to overcome force from the spring package. The second piston is housed at least partially inside the second hydraulic cylinder, is in communication with the braking plate, and is selectively movable in an engage direction to supplement the force from the spring package. The brake controller selectively actuates the first piston and the second piston.

In still another embodiment, an elevator system includes an elevator car, a guide rail, structure for selectively moving the elevator car in opposed directions, and a hydraulic-boosted rail brake. The rail brake includes a braking plate, a spring package, and at least one hydraulically operated piston. The braking plate has friction material and is selectively movable relative to the guide rail. The spring package is in communication with the braking plate and biases the friction material to interact with the guide rail, thereby causing braking. The at least one hydraulically operated piston is in communication with the braking plate and is selectively: (a) movable in a release direction to weaken or overcome force from the spring package, and (b) movable in an engage direction to supplement force from the spring package.

DETAILED DESCRIPTION

Figure 1:
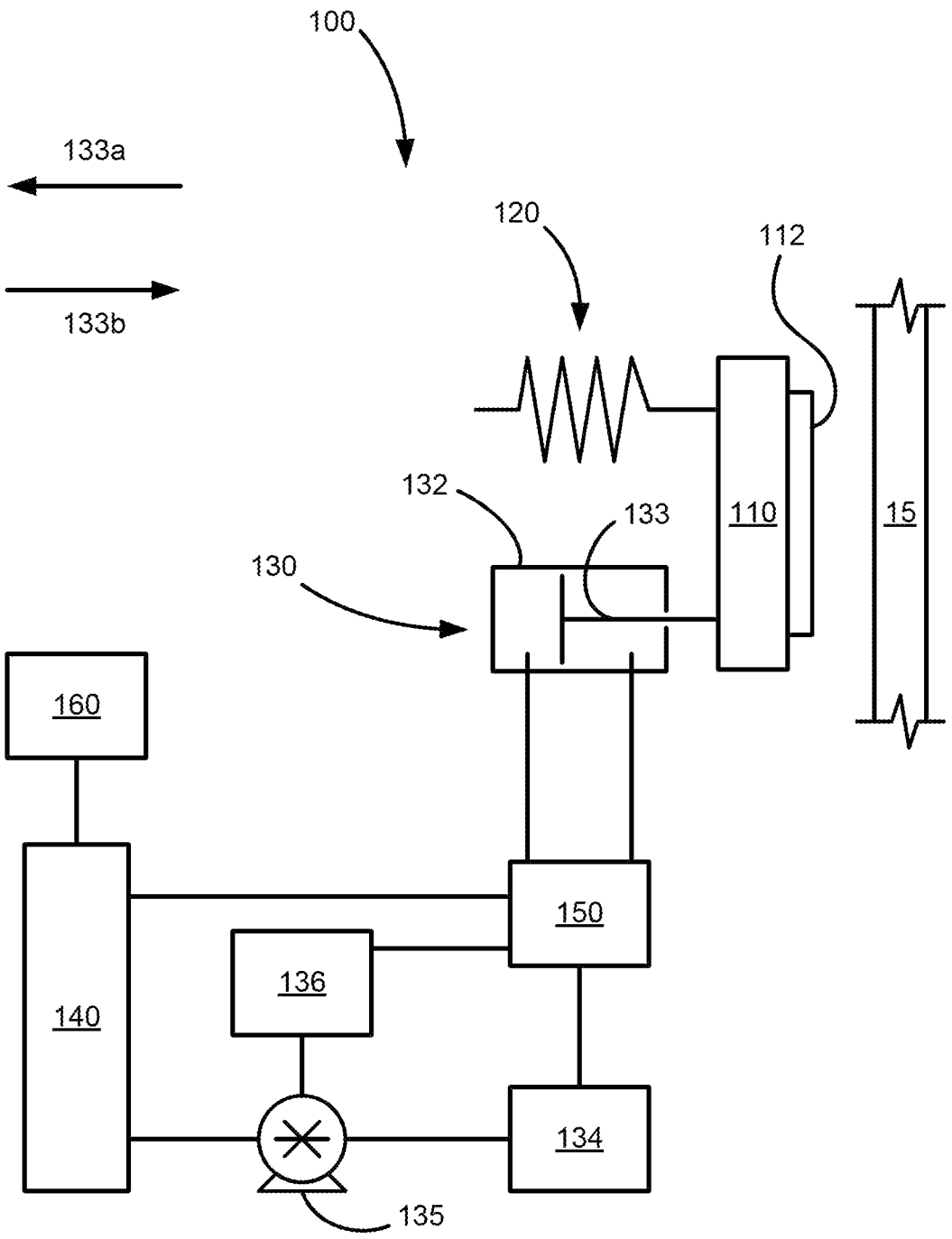
FIG. 1 is schematic view of a hydraulic-boosted rail brake for use with an elevator having a guide rail, in accordance with one embodiment of the current invention.
Figure 2A:
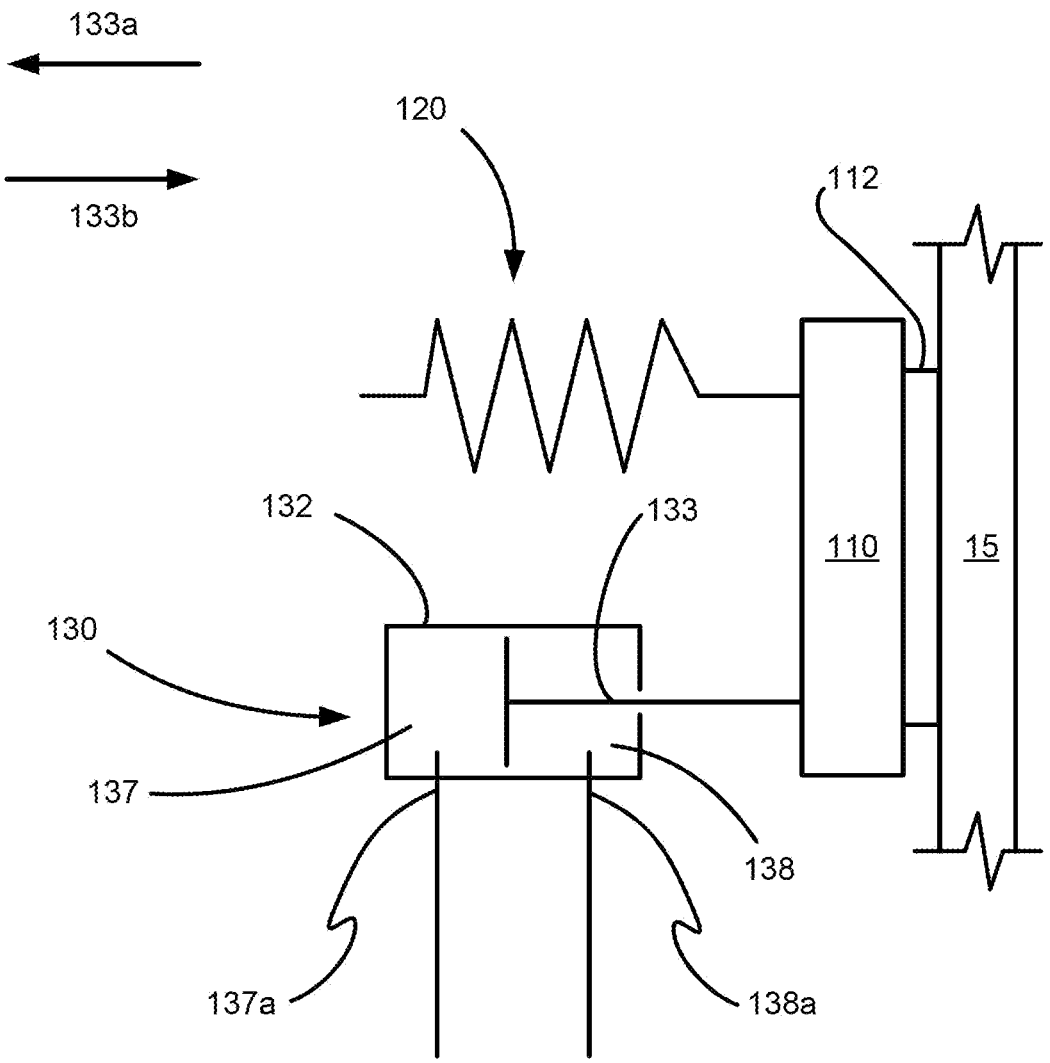
FIG. 2A is a partial view taken from FIG. 1, with the rail brake shown at an engaged configuration with a disengaged piston.
Figure 2B:
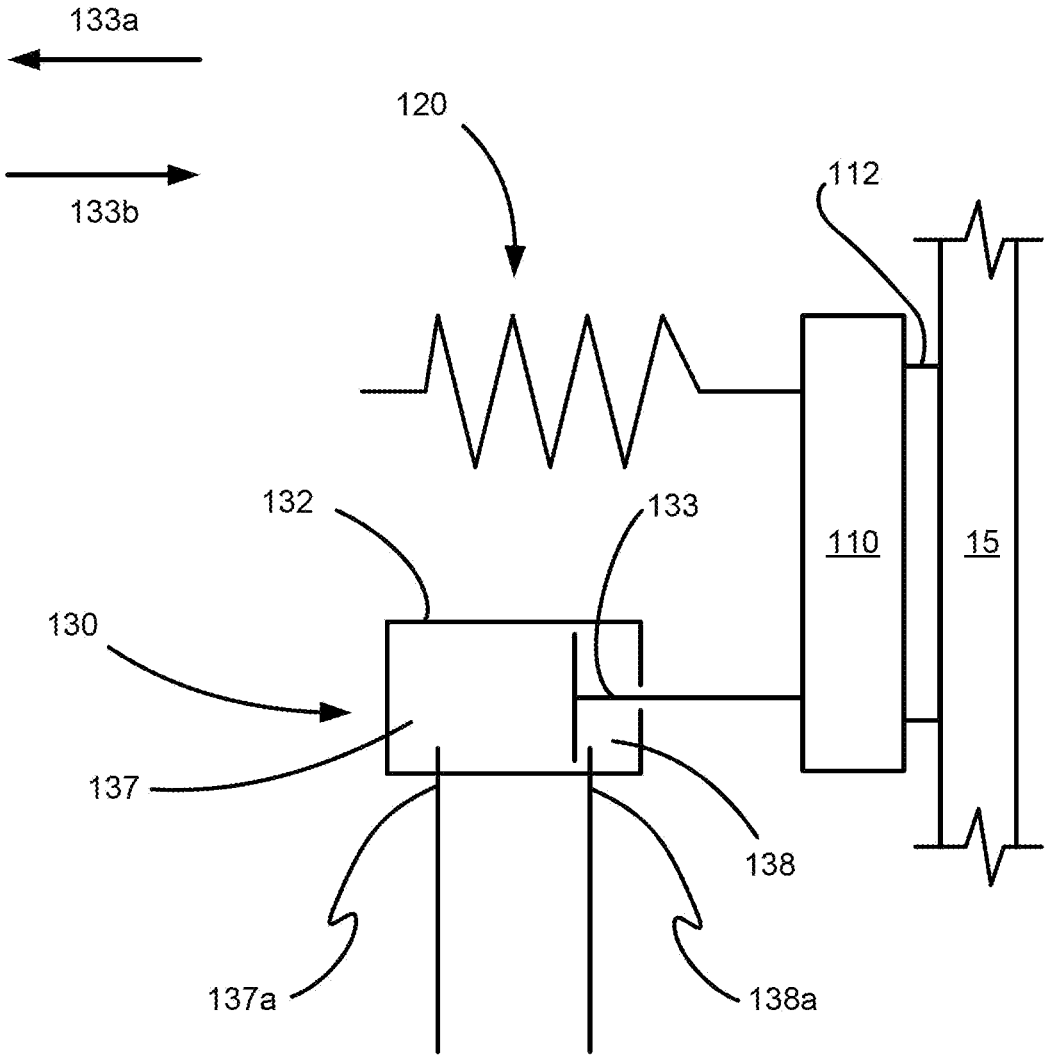
FIG. 2B is a partial view taken from FIG. 1, with the rail brake shown at an engaged configuration with an engaged piston.
Figure 3:
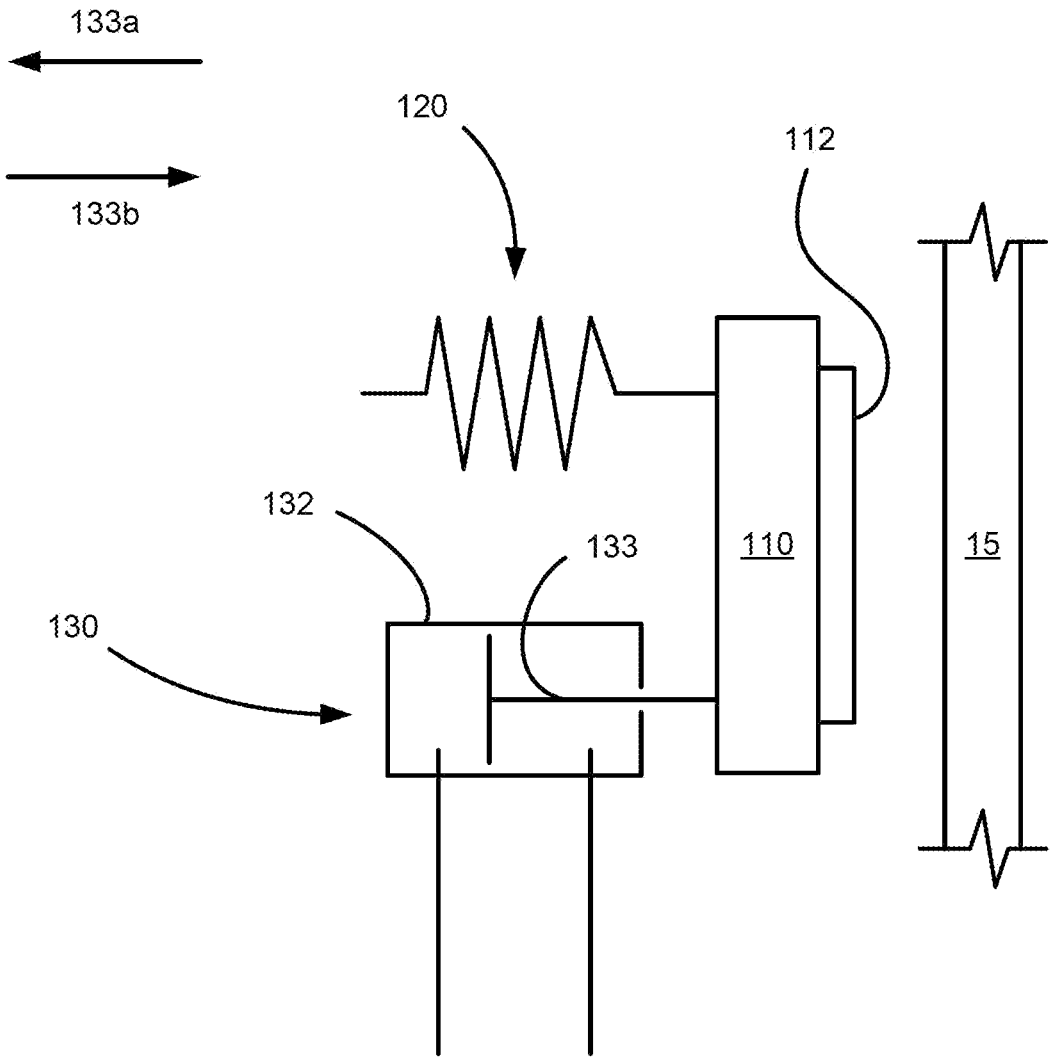
FIG. 3 is a partial view taken from FIG. 1, with the rail brake shown at a disengaged configuration.

FIGS. 1 through 3 show one embodiment 100 of a hydraulic boosted rail brake, for use with an elevator system having an elevator car and a guide rail 15. A braking plate 110 has friction material 112 (e.g., a brake pad), is adjacent the guide rail 15, and is selectively movable relative to the guide rail 15. The braking plate 110 may be constructed of a metal such as steel, a ceramic, a ceramic composite, a carbon composite, or other appropriate material. The friction material 112 may be removably attached to the braking plate 110 for easy replacement. Braking plates and brake pads are known in the art and may have various shapes, material compositions, and sizes. For example, U.S. Patent Publication Number 2011/0100761 assigned to ThyssenKrupp Elevator AG, the contents of which are incorporated by reference herein in their entirety, discloses braking modules labeled 6*f*, 6*h*, and 6*j* and brake pads labeled 34*f*, 34*h*, and 34*j*. Any appropriate braking plate and brake pad, whether now known or later developed, may be utilized.

A spring package 120 is in communication with the braking plate 110 and biases the friction material 112 to interact with the guide rail 15, causing braking. The spring package 120 may include one or more spring. In some embodiments, at least one helical spring may be used in the spring package 120. In alternate embodiments, magnetic springs or other types of springs or biasing mechanisms may be incorporated, whether now know or later developed. Regardless of the specific composition of the spring package 120, the spring package 120 is preferably fixed relative to the elevator car, and one part of the spring package 120 is operatively coupled to the braking plate 110. In some embodiments, spring package 120 outputs a sufficiently large compression force to catch a car during a safety braking operation or an emergency braking operation. In alternate embodiments, it may be permissible to use a spring package 120 that outputs less force upon the braking plate 110 than is common in the art such that the spring package 120 and a hydraulically operated piston 130 cooperate to output a sufficiently large compression force required to catch a car during safety braking operation or emergency braking operation. This may in turn reduce the weight of the rail brake 100 compared to prior art devices, resulting in less energy being required to operate the elevator.

Hydraulically operated piston 130 is also fixed relative to the elevator car, and includes a hydraulic cylinder 132 and a piston 133 housed at least partially inside the cylinder 132. The piston 133 is operatively coupled to the braking plate 110 and is a "double-acting" piston, selectively movable in opposite directions—a release direction 133*a* to diminish or overcome a force from the spring package 120, and an engage direction 133*b* to supplement the force from the spring package 120. A brake controller 140 selectively causes the piston 133 to move in the release direction 133*a* and in the engage direction 133*b*, as described further below.

Hydraulic fluid for the hydraulically operated piston 130 is housed in a pressurized tank 134, and a pump 135 maintains the pressure in the tank 134 using fluid from reservoir 136. The pump 135 may be in data communication with the controller 140 (e.g. through wired or wireless methods). A pressure sensor monitoring the fluid in the tank 134 may provide pressure data to the controller 140; that data may in turn be used to determine whether the pump 135 should be activated or deactivated to maintain a desired pressure. In an alternate embodiment (and especially if the desired pressure in the tank 134 is intended to be rarely changed), a mechanical pressure regulator in fluid communication with the tank 134 and the pump 135 may be used and data communication between the controller 140 and the pump 135 may be unnecessary. The mechanical pressure regulator may nevertheless be considered part of the brake controller 140 even if separate from other portions of the brake controller 140, however, as there is no requirement that the brake controller 140 consist of a unitary device or be contained in a single housing.

Continuing, a valve unit 150 is in data communication with the brake controller 140 and in fluid communication with the pressurized tank 134 as shown in FIG. 1. The brake controller 140 actuates the valve unit 150 to move the piston 133 in the release direction 133*a* or in the engage direction 133*b*, or to disengage the piston 133 (allowing the piston 133 to float). The valve unit 150 may have various configurations, and may for example include a four-way valve or four two-way valves. Those skilled in the art will appreciate that these (and other) various valve configurations may be used, and Bud Trinkel, *Hydraulics & Pneumatics, Book* 2, *Chapter* 8*: Directional Control Valves* (2008), available at http://hydraulicspneumatics.com/other-technologies/book-2-chapter-8-directional-control-valves accompanies this document in an Information Disclosure Statement and is incorporated herein by reference for the benefit of the layman or novice to further describe some appropriate valve configurations.

Sensors 160 may be in data communication with the brake controller 140 to provide various input useful in the operation and monitoring of the rail brake 100. The sensors 160 may include, for example, a position sensor associated with the piston 133 to provide positional data for the piston 133, the pressure sensor associated with the pressurized tank 134 previously discussed, a pressure sensor associated with each side of the piston 133 to provide pressure data for the hydraulic piston 130, and a sensor for determining velocity and acceleration of the elevator car.

FIG. 2A depicts a first mode of brake application where friction material 112 abuts guide rail 15, applying a braking force from spring package 120. Piston 133 is disengaged and is therefore applying no force. FIG. 2B depicts a second mode of brake application, wherein a braking force is applied from the spring package 120 and a supplemental braking force is applied by the hydraulic piston 130. Hydraulic fluid is pumped into an engage end 137 of hydraulic cylinder 132 to move the piston 133 in the engage direction 133*b*. Hydraulic fluid in a release end 138 is evacuated out of a release port 138*a* and into the tank 134 or the reservoir 136. The amount of movement in the engage direction 133*b* may be varied in some embodiments based on the controller's determination of how much additional force is desirable. In other embodiments, the amount of movement may be predetermined. Either way, movement may be subsequently varied through an iterative feedback process. In some embodiments, the controller 140 determines if additional force is desirable—for example, by comparing velocity or acceleration of the elevator car (using data from the sensors 160) to a preferred value or range, by considering an estimated or measured condition of the friction material 112 (e.g., how "worn" the friction material 112 is), by considering a particular composition of the friction material 112, by considering the variations in friction factor of the friction material 112 or rail 15 (e.g. rail is wet), or by recognizing or estimating spring degradation.

To overcome or decrease a force from the spring package 120 on rail 15, the controller 140 may actuate the valve unit 150 to move the piston 133 in the release direction 133*a*. FIG. 3 shows the friction material 112 separated from the guide rail 15 by an air gap. Hydraulic fluid is pumped into the release end 138 of the hydraulic cylinder 132 to move the piston 133 in the release direction 133*a*. Hydraulic fluid in the engage end 137 is evacuated out of an engage port 137*a* and into the tank 134 or the reservoir 136. As with adding force to rail 15, the amount of movement (though here in the release direction 133*a*) may be varied in some embodiments based on the controller's determination of how much change in force is desirable, and in other embodiments the amount of movement may be predetermined. Either way, movement may be subsequently varied through an iterative feedback process.

So with the adjustments provided by the spring package 120 and the hydraulically operated piston 130, the rail brake 100 can function as an operational brake, as an emergency brake, and as a safety brake. For operational braking, the spring package 120 (either alone or with supplementation from the hydraulically operated piston 130) holds the car at respective landings. For emergency braking, the spring package 120, with selective cooperation from the hydraulically operated piston 130, applies appropriate forces to slow the car if upward or downward speed of the car is too great. And for safety braking, the spring package 120, with selective cooperation from the hydraulically operated piston 130, applies appropriate forces to stop the car if a free-fall would otherwise occur.

The extensive adjustments available through the spring package 120 and the piston 130 allow the controller 140 to precisely control the air gap between friction material 112 and rail 15. In some embodiments, the hydraulically operated piston 130 is manipulated to dampen the initial force applied by friction material 112 to the rail 156 from spring package 120, reducing the noise level and jerk associated with initial brake application. In other embodiments, the air gap may be minimized at low car speeds and maximized during high car speeds by varying the position of the piston 133 within the hydraulic cylinder 132. In yet other embodiments, the air gap may be dynamically reduced as a car decelerates.

Moreover, because the rail brake 100 includes both the spring package 120 and the hydraulically operated piston 130, the rail brake 100 has built-in redundancies important for safe operation. And in practice, it may be desirable to use multiple rail brakes 100 with a single elevator car to increase redundancies for safety and distribute braking forces being applied to the guide rail 15. When multiple rail bakes 100 are used, various parts (e.g., the pressurized tank 134, the pump 135, and the brake controller 140) may be shared across the rail brakes 100. In other embodiments, alternative brake units are used in the same elevator system as at least one rail brake 100. The hydraulically operated piston 130 of rail brake 100 can be used to compensate for failures and performance variations in the alternative brake units.

If the controller 140 determines that there is a leak or pressure failure (e.g., using data from the pressure sensor 160 associated with the pressurized tank 134, or using data from the sensors 160 associated with each side of the piston 133), the controller 140 may allow the friction material 112 to abut the guide rail 15 as shown in FIGS. 2A and 2B for preventative safety braking. This braking may happen suddenly, or more preferably, in a measured manner. For example, preventative safety braking may be applied such that the elevator car comes to a stop at a closest floor landing. If the rail brake 100 actually loses hydraulic pressure, the piston 133 loses the ability to overcome the force of the spring package 120; thus, the spring package 120 will automatically provide braking even without any input from the controller 140. In the event of a power failure, rail brake 100 can continue normal operation as long as pressure within the pressurized tank 134 stays above a minimum threshold level.

For further illustration, the following Table 1 shows example variations of braking forces that may be achieved using one embodiment of the rail brake 100, assuming a braking retardation of 0.6 g.

TABLE 1

| Load case | Nominal load (Q) (lbs) | Nominal load (Q) (kg) | Car mass (P) (kg) | Counterweight-less Empty (kN) | Counterweight-less Full (kN) | Counterweight Empty (kN) | Counterweight Full (kN) |
|---|---|---|---|---|---|---|---|
| 1 | 2100 | 953 | 667 | 10.47 | 25.42 | 15.32 | 14.20 |
| 2 | 2500 | 1134 | 794 | 12.46 | 30.26 | 18.24 | 16.91 |
| 3 | 3000 | 1361 | 953 | 14.95 | 36.31 | 21.89 | 20.29 |
| 4 | 3500 | 1588 | 1111 | 17.44 | 42.36 | 25.54 | 23.67 |
| 5 | 4000 | 1814 | 1270 | 19.93 | 48.41 | 29.19 | 27.05 |
| 6 | 5000 | 2268 | 1588 | 24.92 | 60.52 | 36.49 | 33.82 |

Figure 4:
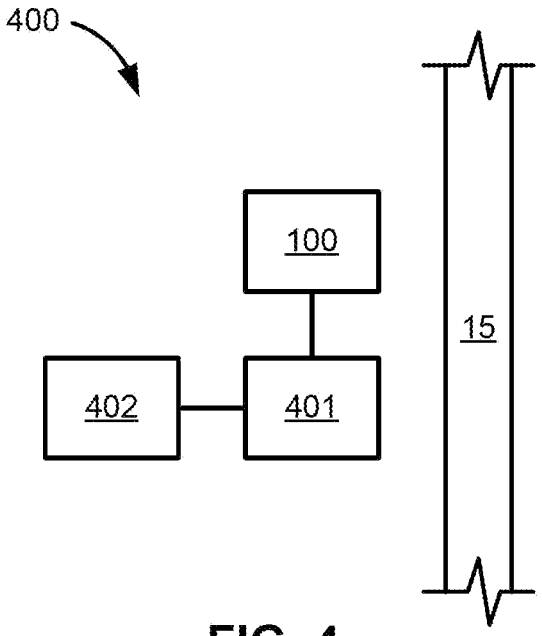
FIG. 4 is a schematic view of an elevator system having the hydraulic-boosted rail brake of FIG. 1.

FIG. 4 illustrates an elevator system 400 that uses the rail brake 100 shown in FIGS. 1-3 and discussed above. In addition to the rail brake 100, the elevator system 400 includes an elevator car 401, the guide rail 15, and means 402 for selectively moving the elevator car 401 in opposed directions (e.g., up and down). The means 402 for selectively moving the car 401 may for example be a motor, sheave, and cable system. One such appropriate system is shown in U.S. Pat. No. 7,360,630 assigned to ThyssenKrupp Elevator Capital Corporation, the contents of which are incorporated herein in their entirety by reference.

Figure 5:
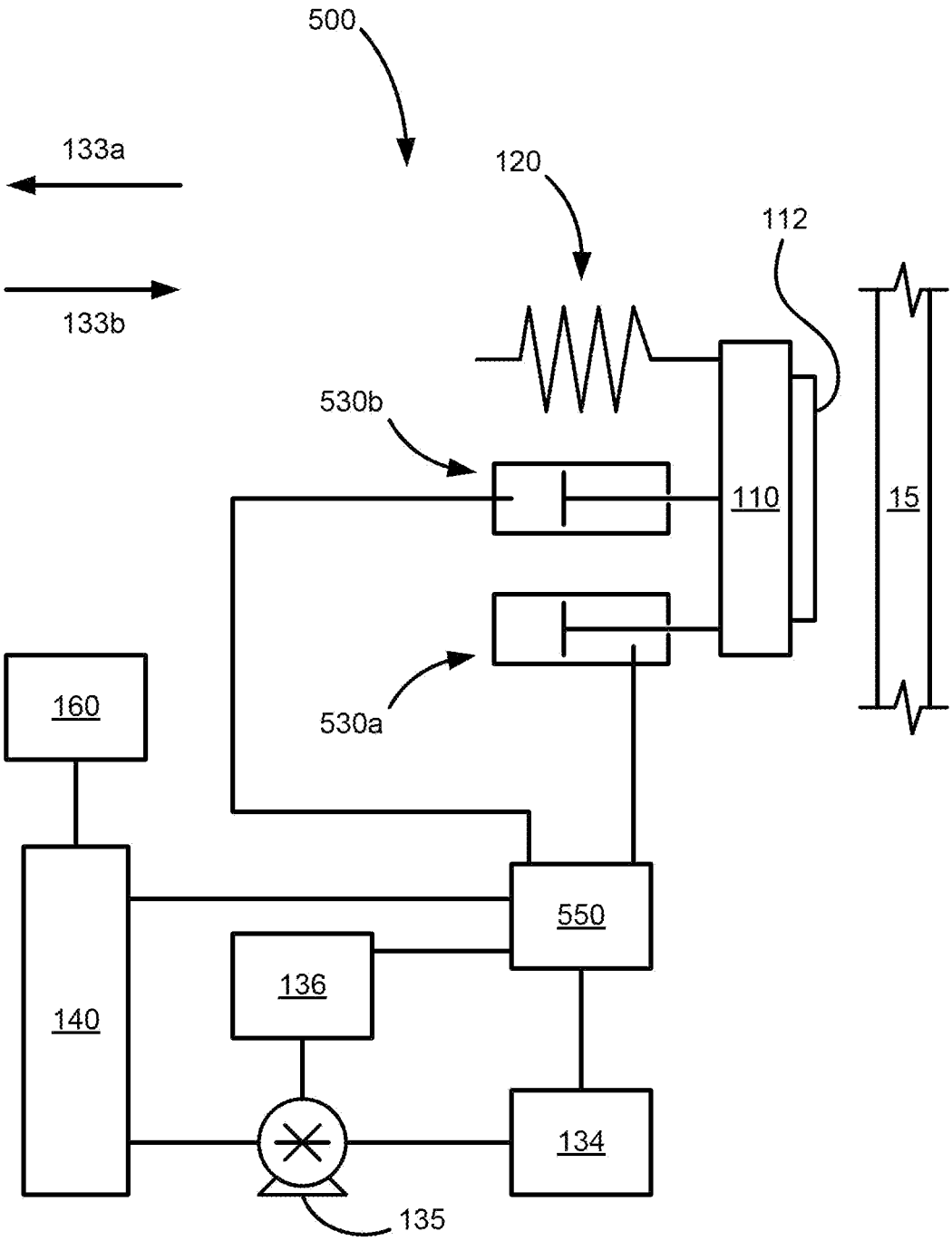
FIG. 5 is a schematic view of a hydraulic-boosted rail brake for use with an elevator having a guide rail, in accordance with another embodiment of the current invention.

FIG. 5 shows another rail brake 500 that is substantially similar to the embodiment 100, except as specifically noted and/or shown, or as would be inherent. Further, those skilled in the art will appreciate that the embodiment 100 (and thus the embodiment 500) may be modified in various ways. For uniformity and brevity, corresponding reference numbers may be used to indicate corresponding parts, though with any noted deviations.

Embodiment 500 replaces the double-acting piston 130 with two single-acting pistons 530*a*, 530*b*, and replaces the valve unit 150 with a valve unit 550 appropriate for actuating the piston 530*a* in the release direction 133*a* and actuating the piston 530*b* in the engage direction 133*b*. In use, as will be appreciated by those skilled in the art, the pistons 530*a*, 530*b* (operated by the valve unit 550) collectively provide the function of the piston 130.

Figure 6:
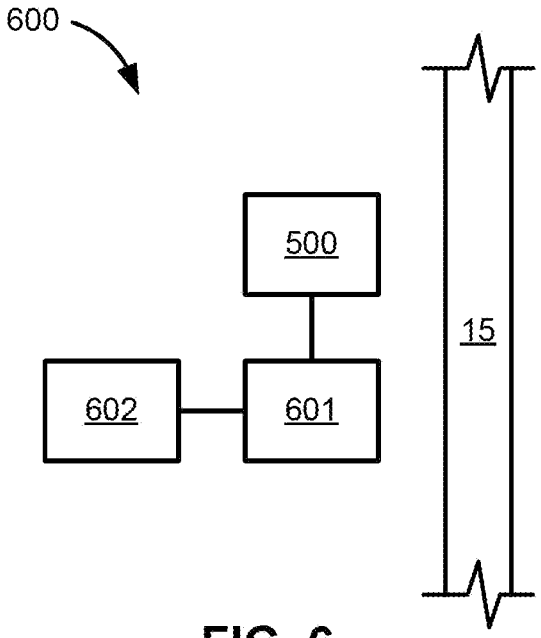
FIG. 6 is a schematic view of an elevator system having the hydraulic-boosted rail brake of FIG. 5.

FIG. 6 illustrates an elevator system 600 that uses the rail brake 500 shown in FIG. 5 and discussed above. In addition to the rail brake 500, the elevator system 600 includes an elevator car 601 (which may be substantially similar to the elevator car 401), the guide rail 15, and means 602 for selectively moving the elevator car 601 in opposed directions (e.g., up and down). The means 602 for selectively moving the car 601 may be substantially similar to the means for moving the car 401, as discussed above for example.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. The specific configurations and contours set forth in the accompanying drawings are illustrative and not limiting. All steps need not be performed in the order shown or described.

What is claimed is:

1. A hydraulic-boosted rail brake for use with an elevator having a guide rail, comprising:

a braking plate having friction material, the braking plate being selectively movable relative to the guide rail;

a spring package in communication with the braking plate, the spring package biasing the friction material to interact with the guide rail whereby causing braking;

a hydraulic cylinder;

a piston housed at least partially inside the hydraulic cylinder, the piston being in communication with the braking plate and selectively: (a) movable in a release direction to diminish or overcome force from the spring package; and (b) movable in an engage direction to supplement the force from the spring package; and a brake controller selectively causing the piston to move in the release direction and in the engage direction;

wherein the brake controller selectively deactivates the piston such that the force from the spring package is neither overcome nor enhanced by the piston.

2. The rail brake of claim 1, further comprising a sensor in data communication with the brake controller, the sensor providing the brake controller positional data for the piston.

3. The rail brake of claim 1, wherein the spring package includes a helical spring.

4. The rail brake of claim 1, wherein movement of the piston in the release direction is adjustable by the brake controller, and wherein movement of the piston in the engage direction is adjustable by the brake controller.

5. The rail brake of claim 1, further comprising:

a pump;

a pressurized tank of hydraulic fluid;

a valve unit in fluid communication with the pressurized tank of hydraulic fluid, the valve unit being in data communication with the brake controller and configured to be operated by the brake controller to direct a flow of hydraulic fluid to selectively move the piston in the release direction and in the engage direction.

6. The rail brake of claim 5, further comprising:

a sensor in data communication with the brake controller, the sensor providing the brake controller pressure data for the hydraulic tank; and programming in data communication with the brake controller, the programming causing the brake controller to deactivate the piston when the pressure data indicates that pressure inside the hydraulic tank is less than a predetermined pressure.

7. The rail brake of claim 6, wherein movement of the piston in the release direction is adjustable by the brake controller, and wherein movement of the piston in the engage direction is adjustable by the brake controller.

8. The rail brake of claim 7, wherein the spring package includes a helical spring.

9. An elevator system, comprising:

an elevator car;

a guide rail;

means for selectively moving the elevator car in opposed directions; and a hydraulic-boosted rail brake comprising:

a braking plate having friction material, the braking plate being selectively movable relative to the guide rail;

a spring package in communication with the braking plate, the spring package biasing the friction material to interact with the guide rail whereby causing braking;

at least one hydraulically operated piston in communication with the braking plate and selectively: (a) movable in a release direction to overcome force from the spring package; (b) movable in an engage direction to supplement force from the spring package; and (c) deactivatable such that the force from the spring package is neither overcome nor enhanced by the piston; and a brake controller selectively causing the movement in the release direction, the movement in the engage direction, and the deactivation.

10. The rail brake of claim 9, wherein a minimum air gap between the friction material and the guide rail is smaller when the car travels at low velocities than the minimum air gap when the car travels at high velocities.

* * * * *